US006840332B2

(12) United States Patent
Winger

(10) Patent No.: US 6,840,332 B2
(45) Date of Patent: Jan. 11, 2005

(54) ROAD SCRAPER

(76) Inventor: Thomas E. Winger, 622 S. Vine, Jefferson, IA (US) 50129

( * ) Notice: Subject to any disclaimer, the term of this patent is extended or adjusted under 35 U.S.C. 154(b) by 32 days.

(21) Appl. No.: 10/382,047

(22) Filed: Mar. 5, 2003

(65) Prior Publication Data

US 2004/0188116 A1 Sep. 30, 2004

(51) Int. Cl.[7] ..... A01B 5/00; A01B 49/02
(52) U.S. Cl. ..... 172/199; 172/684.5
(58) Field of Search ..... 172/200, 199, 172/684.5

(56) References Cited

U.S. PATENT DOCUMENTS 536,130 A * 3/1895 Cleveland ..... 172/200
1,155,862 A * 10/1915 Yeager ..... 172/178
1,484,497 A * 2/1924 Hicks ..... 172/684.5
1,861,494 A * 6/1932 Devereux ..... 172/684.5
3,047,969 A 8/1962 Purdy
3,063,178 A 11/1962 Purdy
3,348,323 A 10/1967 Purdy
4,244,662 A 1/1981 Olson
5,071,284 A 12/1991 Constantin
5,330,287 A 7/1994 Constantin

* cited by examiner

*Primary Examiner*—Christopher J. Novosad
(74) *Attorney, Agent, or Firm*—McKee, Voorhees & Sease, P.L.C.

(57) ABSTRACT

A road scraper includes a frame having forwardly positioned blades extending rearwardly and laterally for directing loose material against a rear blade extending angularly in the opposite direction between rearwardly extending side frame members thereby causing loose material on the road to be redistributed across the road under the rear blade on the back side of the frame. A rearwardly positioned dam blade cooperates with the rear angular blade to cause loose material to be accumulated and then discharged through a passageway between the rear end of the dam blade and the angular blade.

8 Claims, 12 Drawing Sheets

ROAD SCRAPER

BACKGROUND OF THE INVENTION

This invention relates to maintenance of unsurfaced roads such as are typically maintained by road graders. A road grader is a very expensive piece of equipment and thus a low cost vehicle-drawn scraper is needed as an alternative.

BRIEF SUMMARY OF THE INVENTION

The road scraper of this invention can be drawn behind a pickup truck or tractor and operated at speeds of twenty miles per hour. The frame of the scraper carries a plurality of angled blades extending angularly, rearwardly and laterally from a long side frame member towards a shorter side frame member. The rear ends of the two side frame members are interconnected by a diagonally extending frame member also having a blade secured to it. The top layer of material on the road surface is engaged by the angularly extending blades and moved rearwardly and laterally across the scraper to the shorter side frame member and then rearwardly along the angularly extending blade member. Some of the loose material will flow under the blade on the angular frame member such that there is an even distribution of loose material across the road as the road scraper moves along the road surface. The action of the scraper blades on the loose material is entirely within the confines of the scraper. The blades are arranged such that the scraper is balanced creating no side draft to either side of the road.

Unlike machines intended to be used in agricultural fields, the road scraper of this invention is intended to only scrape the top surface of the road which is generally a hardened surface with loose pieces of dirt and gravel amongst potholes which will be filled by action of the scraper. While the scraper of this invention can be operated at low speeds, it operates best at the higher speeds on the order of twenty miles per hour.

The scraper of this invention may also be used on farm driveways in one modified embodiment or on racetracks in another embodiment wherein the loose material is substantially all directed to the rear most corner of the scraper where it is discharged as a spray or windrow depending on the speed of travel. Common to all embodiments is the collection of the loose material at the rear of the scraper where it is then allowed to be fully or partially discharged along the rear angular blade through a passageway formed by a rearwardly and angularly extending dam blade.

DETAILED DESCRIPTION OF THE INVENTION

Figure 1:
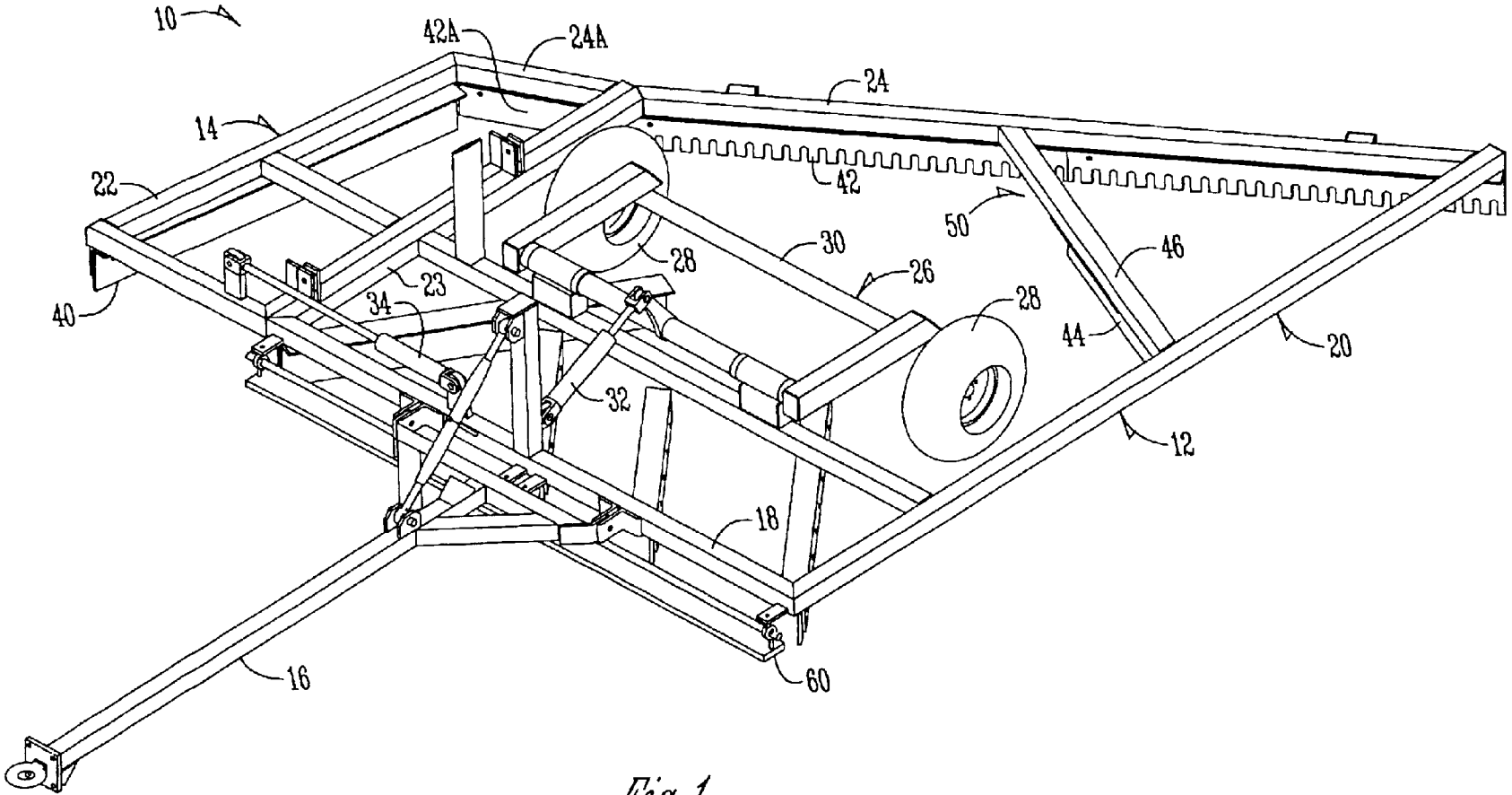
FIG. 1 is a front perspective view of the road scraper of this invention.
Figure 2:
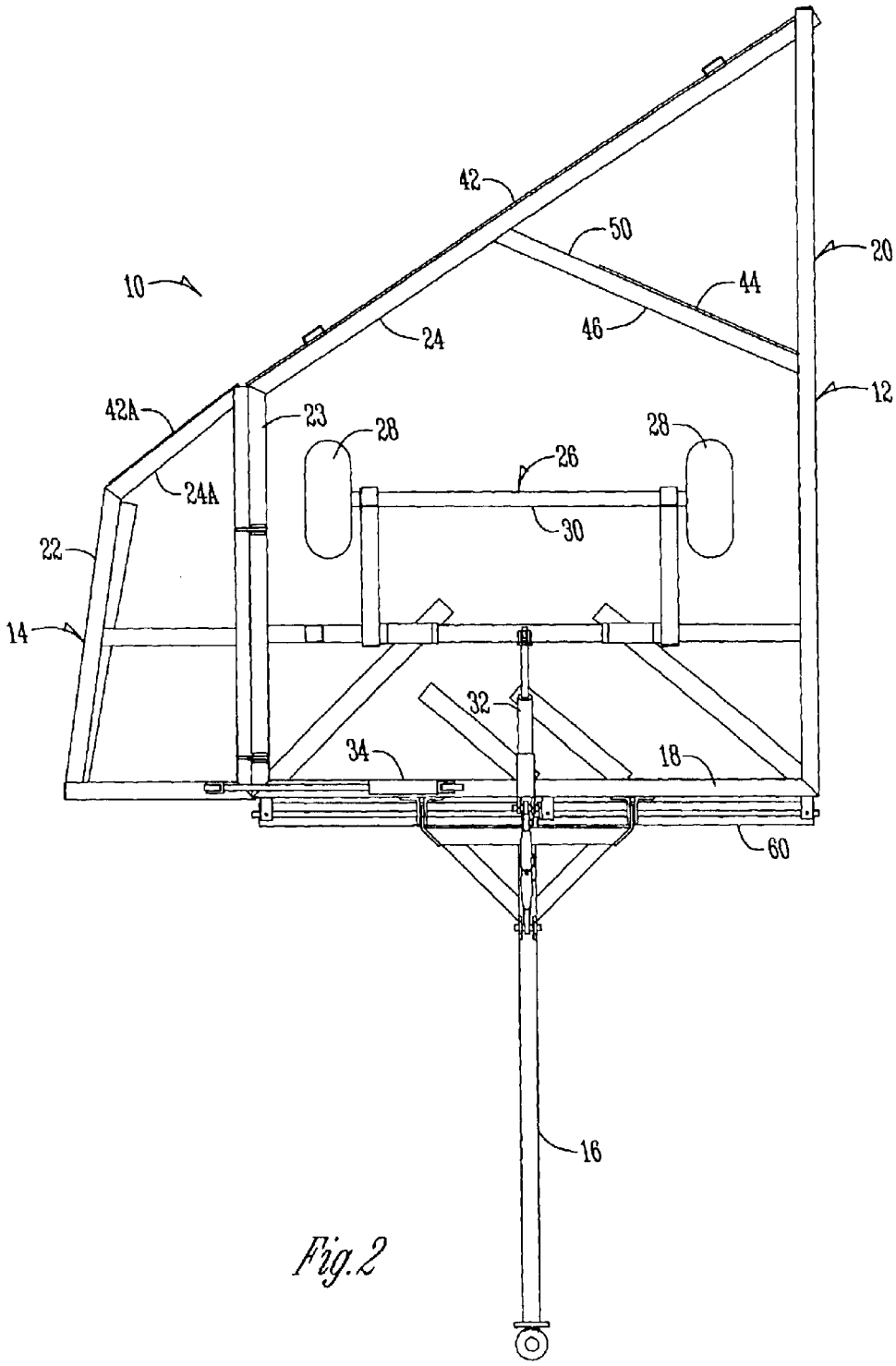
FIG. 2 is a top plan view thereof.
Figure 3:
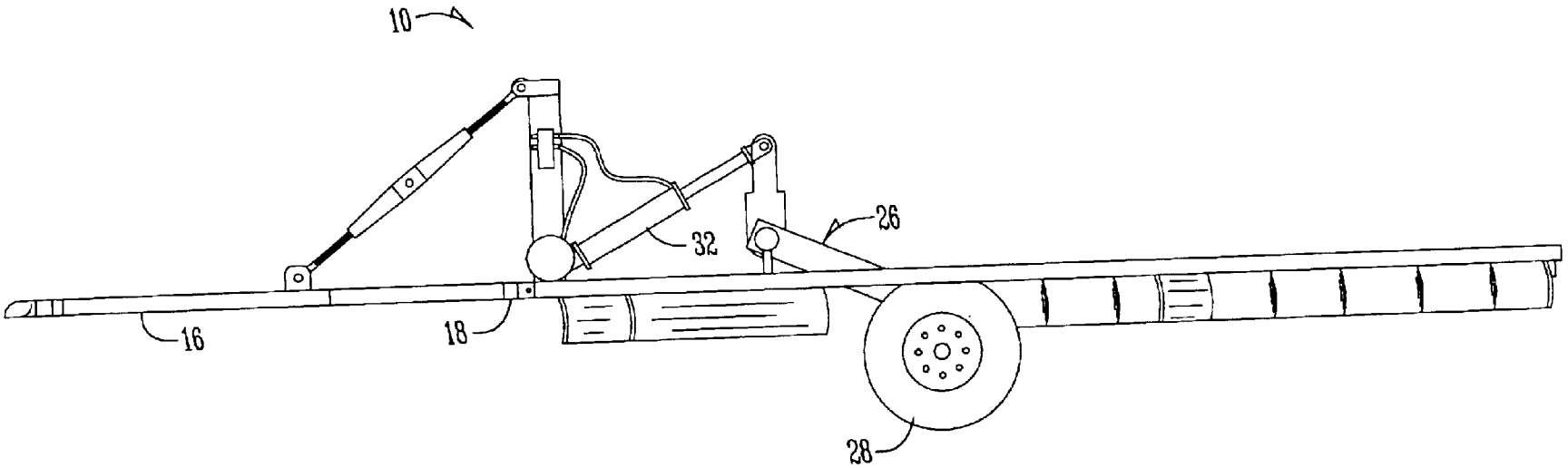
FIG. 3 is a side elevation view thereof.

The road scraper of this invention is referred to generally in FIG. 1 by the reference numeral 10 and includes a main frame 12 to which a pivotal wing section 14 is connected.

A tongue 16 is connected to a front transversely extending frame member 18. The main frame 12 includes a side frame member 20 opposite a shorter opposite side frame member 22 on the pivotal wing section 14. An angular frame member 24 on the main frame 12 extends from the side frame member 20 to an angular frame member 24A on the wing section 14 which in turn engages the shorter side frame member 22. The main frame 12 includes a side frame member 23 extending between the front frame member 18 and the angular frame member 24.

A wheel assembly 26 includes ground transport wheels 28 mounted on a pivotal frame 30 operated by a hydraulic cylinder 32 to raise and lower the wheels 28 for road transport or varying the height of the scraper as it travels along the road surface.

Figure 4:
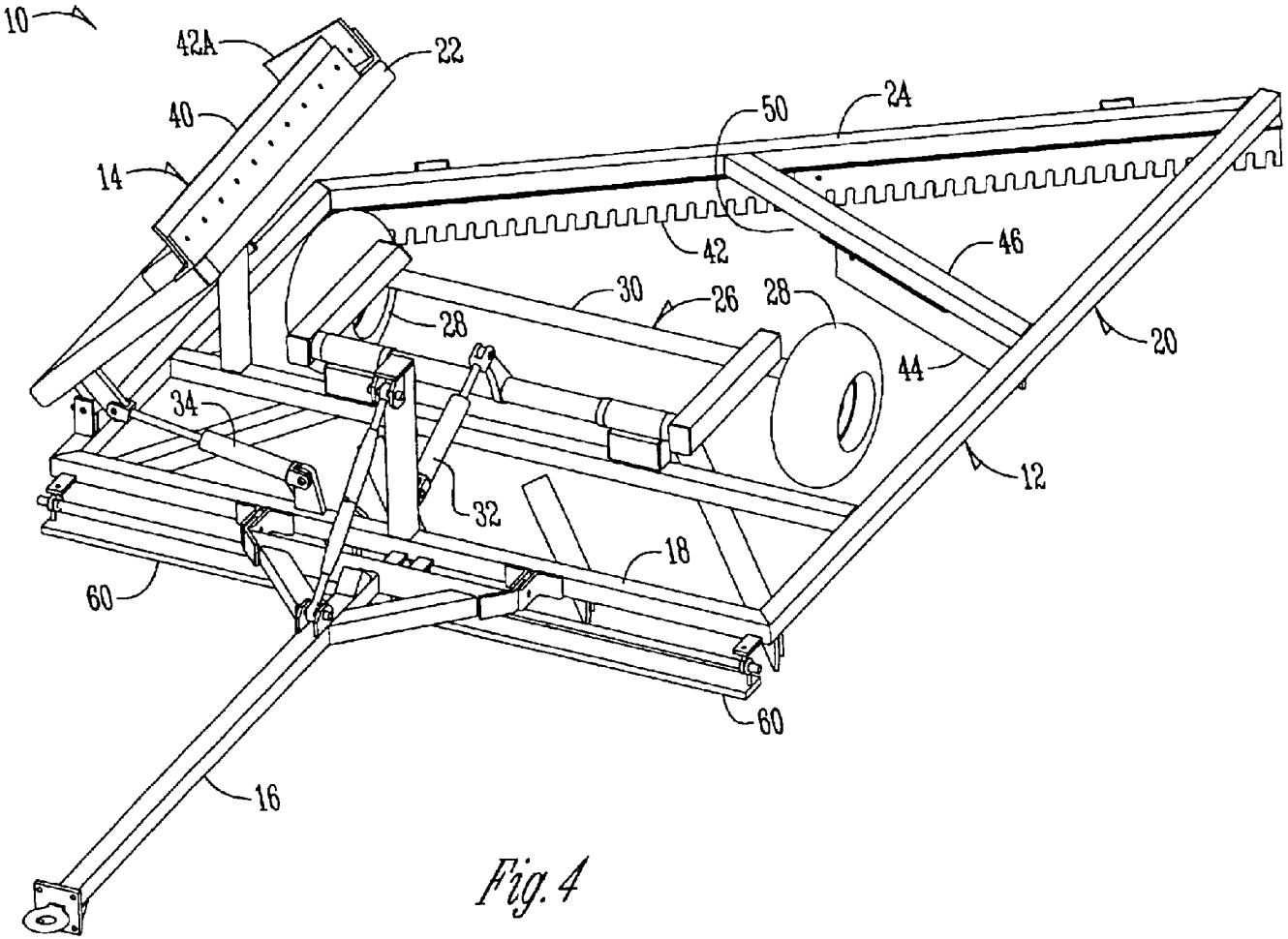
FIG. 4 is a front perspective view similar to FIG. 1 but showing a wing section in a raised transport position.

The pivotal wing section 14 is operated by hydraulic cylinder 34 for pivoting it between a lowered position as seen in FIG. 1 or a raised position as seen in FIG. 4 for transport.

Figure 5:
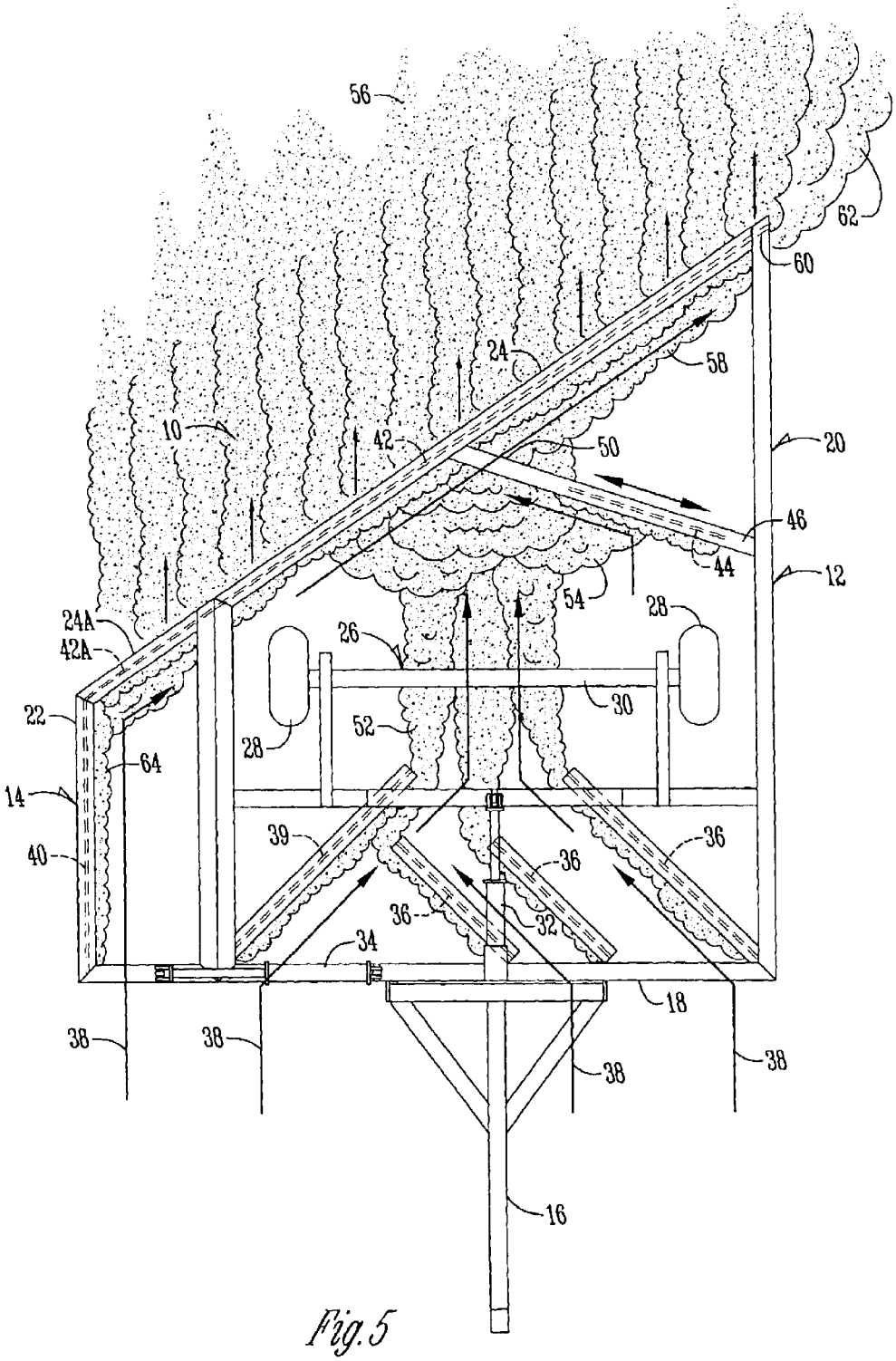
FIG. 5 is a top plan view similar to FIG. 2 but showing the scraper blades in dash lines and the direction of loose material flow into and through the scraper.
Figure 6:
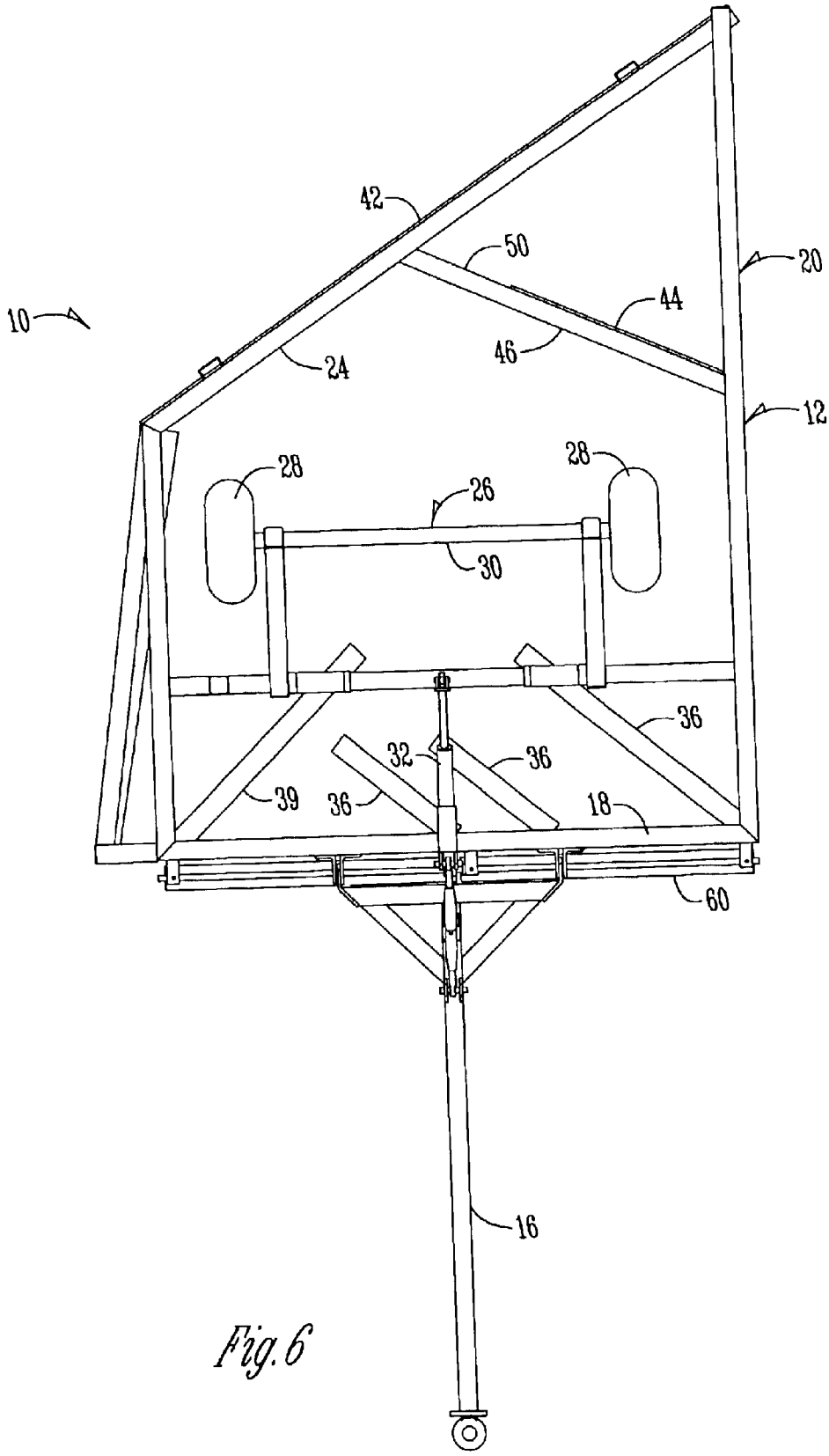
FIG. 6 is a top plan view similar to FIGS. 2 and 5 but showing an alternate embodiment wherein an additional blade is provided at ninety degrees to the adjacent blades to direct loose material away from the ground support wheels and back to the center line of the scraper.
Figure 7:
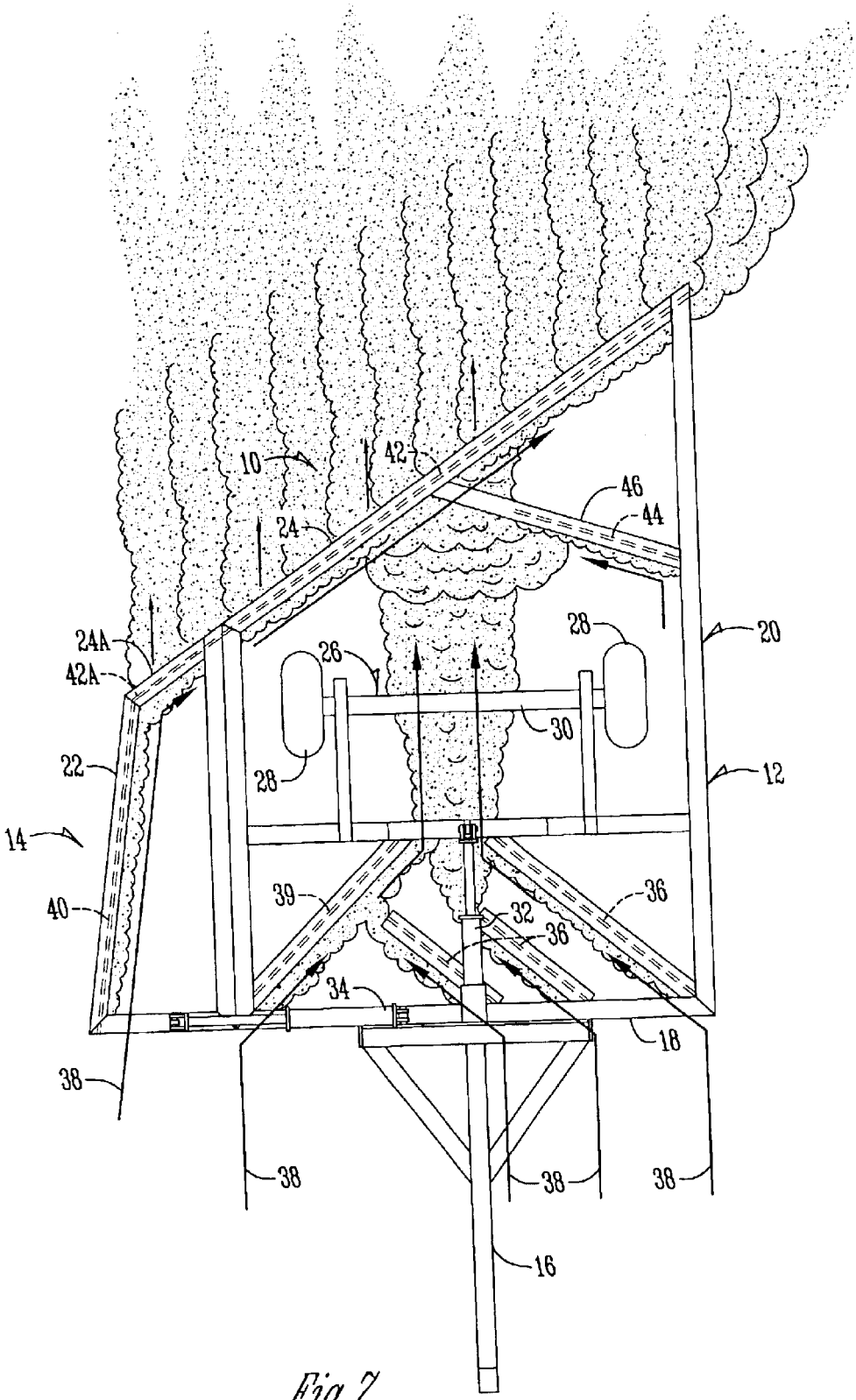
FIG. 7 is a top plan view similar to FIG. 5 but showing an alternate wing section having an outside frame member angled rearwardly to scrape the road surface and guide the loose material rearwardly toward the rear angular blade.

The scraper 10 as seen in FIG. 5 includes three parallel angularly extending blades 36 which direct loose material flow as indicated by the arrows 38 laterally across the scraper 10 toward a blade 39 which extends rearwardly and laterally at approximately ninety degrees to the blades 36. A blade 40 is provided under the shorter side frame member 22 which in turn directs the loose material rearwardly into engagement with a blade 42 on the angularly disposed frame members 24A and 24. A blade 44 is provided on a frame member 46 which terminates short of the blades 42 and 42A to provide a space or passageway 50 therebetween for material to flow through along blades 42 and 42A thereby allowing loose material to exit the grader at the rear end corner of blade 42.

As seen in FIG. 1, an elongated magnet 60 is pivotally provided under the front frame member 18 to pick up loose metal objects such as nails.

The road scraper of this invention may have any desired width but preferred sizes include an eight and a half foot rigid frame, a ten and a half foot rigid frame, and a ten and a half foot fold-up frame as seen in FIGS. 1–6.

The scrapers of FIGS. 1–8 in operation funnel the loose material produced by the blades 36 and 39 to the longitudinal center of the grader 10 where it flows rearwardly as indicated by the reference numeral 52. The blade 44 functions as a dam in cooperation with the blade 42 to cause the loose material 52 to pile up as indicated by the reference numeral 54 and then flow rearwardly under the serrated blade 42 as indicated at 56 as well as through the passageway 50 as indicated at 58 where it exits at the rear most corner 60 of grader 10 forming a windrow or spray 62. Material 64 is also moved by the blade 40 rearwardly and is included in the material 58 which moves along the blades 42A and 42 as seen in FIG. 5.

Figure 10:
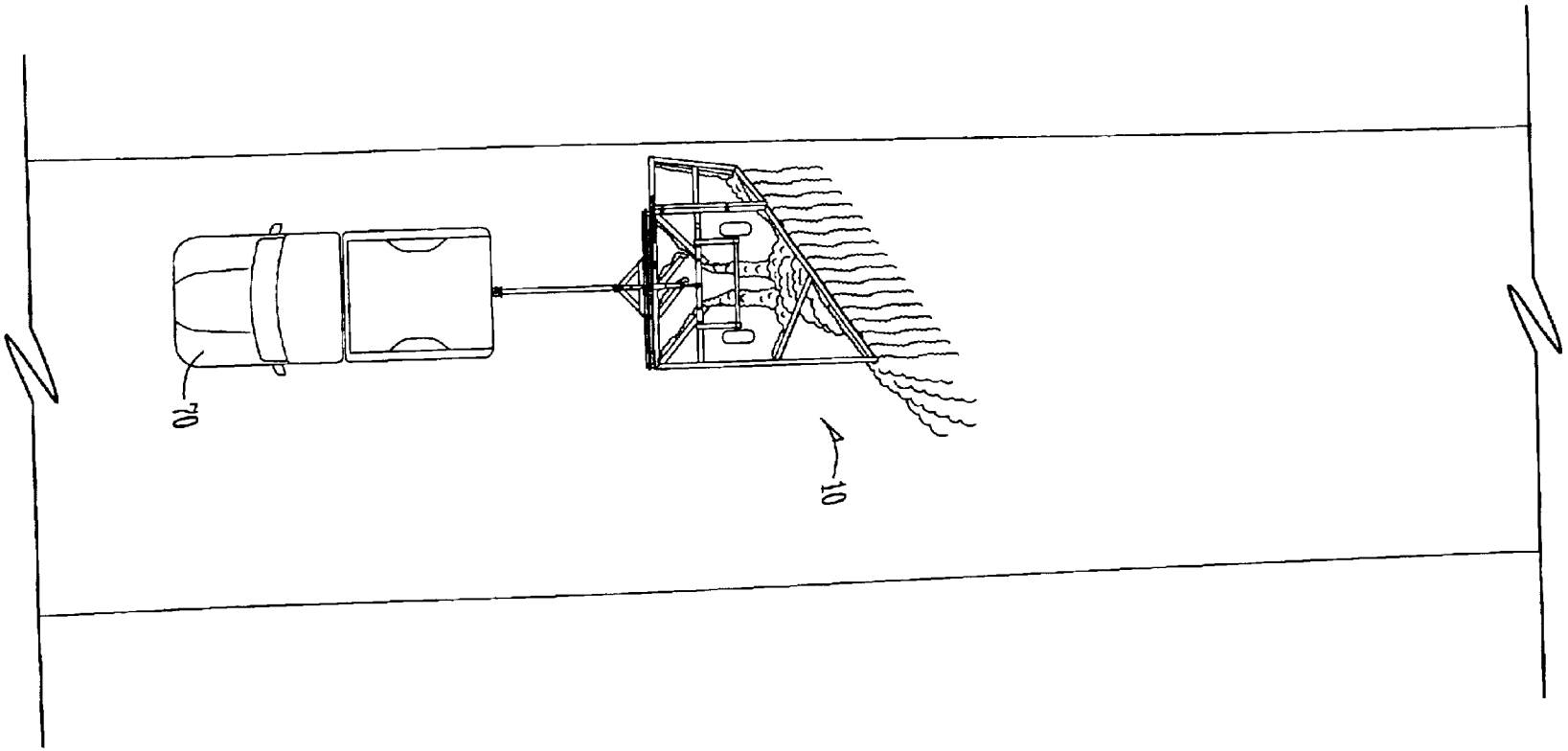
FIG. 10 is a top plan view of the scraper of this invention being used on a two lane dirt or gravel road.

The flow of material through the grader 10 is such that the grader is balanced and is centered behind a vehicle 70 as seen in FIG. 10 at speeds on the order of twenty miles per hour. The amount of material 56 that flows under the blades 42 and 42A compared to the material 62 which is discharged at the corner 60 may be varied as desired. Typically, however, 50 to 70 percent will flow directly rearwardly while 30 to 50 percent will flow out the corner 60 as a windrow or spray 62 or depending on the speed be spread uniformly rearwardly and laterally of the grader 10 as seen in FIG. 5. As seen in FIG. 1, the blade 42 has serrations which may be varied in size to allow more or less material to flow under the blade.

Figure 9:
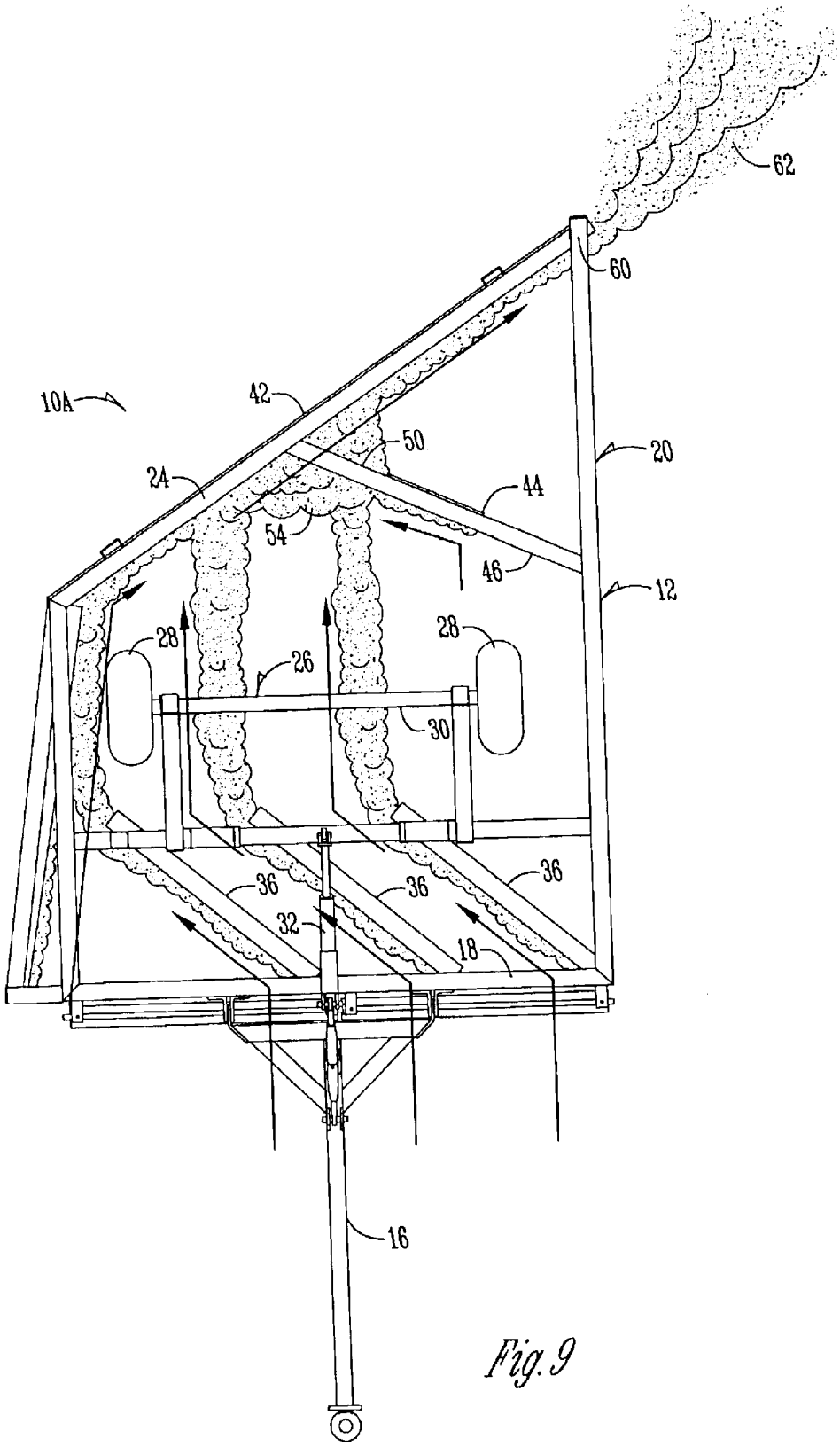
FIG. 9 is a top plan view similar to FIGS. 5–8 but showing an alternate embodiment for use on racetracks wherein the loose material is guided along the rear angular blade to the rear most corner where it is discharged in a windrow or spray.
Figure 11A:
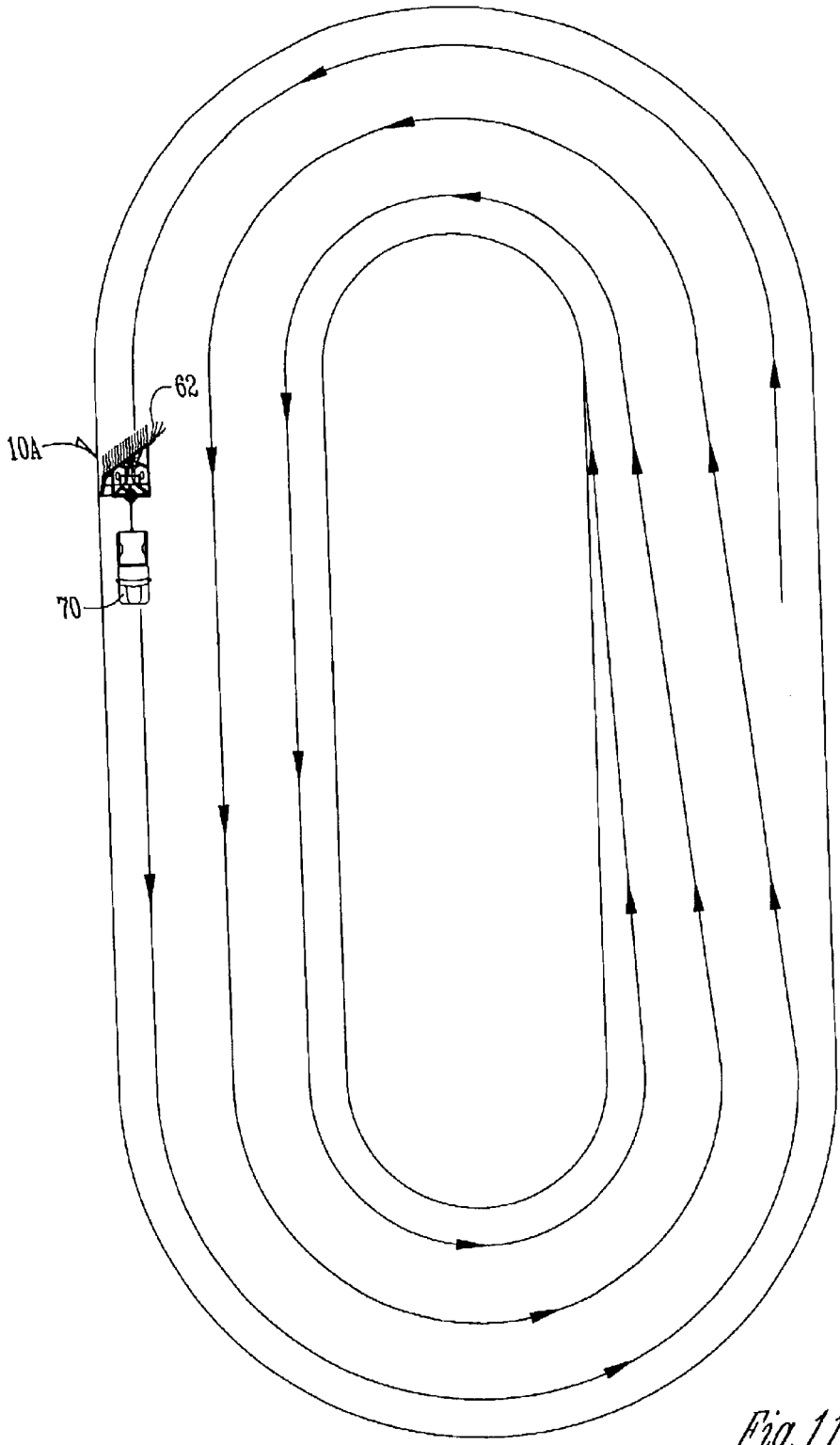
FIG. 11A is a top plan view of a racetrack showing the path of the scraper of FIG. 9 being pulled around the track in a counterclockwise direction.
Figure 11B:
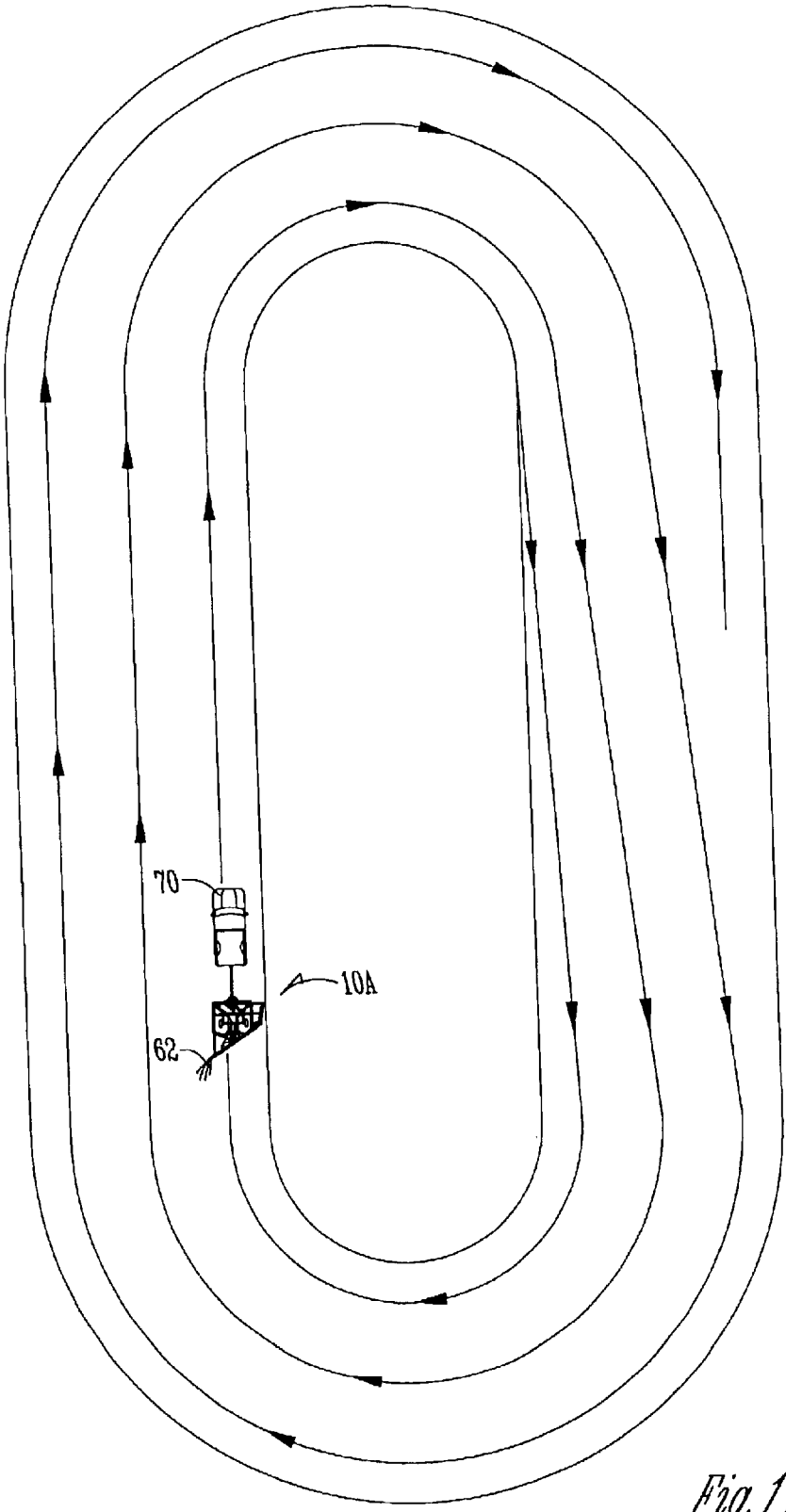
FIG. 11B is a top plan view similar to FIG. 11A but showing the scraper being pulled around the track in a clockwise direction.

An alternate embodiment grader 10A is shown in FIGS. 9, 11A and 11B functioning much the same way as grader 10 in directing loose material laterally and rearwardly by blades 36 into a pile 54 created by the dam blade 44 and blade 42 with the loose material then passing through the passageway 50 along blade 42 to the rear corner 60 where it is discharged as a windrow or spray 62 or is fanned out rearwardly and laterally of the grader 10A. This particular operation is suitable for racetrack grading as seen in FIGS. 11A and 11B showing the grader going in a counterclockwise direction in FIG. 11A and a clockwise direction in FIG. 11B. The blade 42 in this embodiment does not have serrations thus restricting the flow of material under it.

Figure 8:
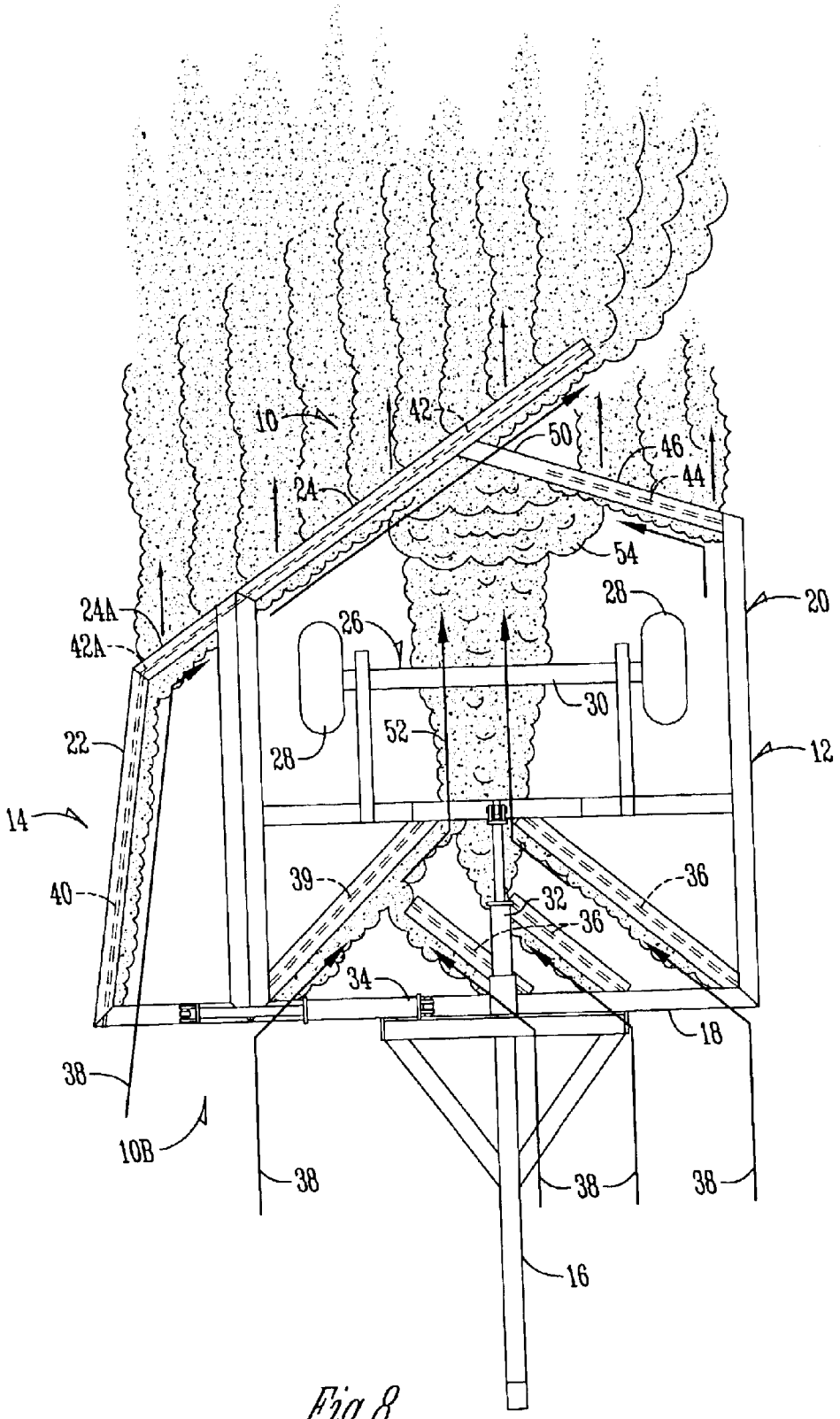
FIG. 8 is a top plan view similar to FIGS. 5 and 7 of a scraper for farm driveways which eliminates a windrow or spray of loose material along the driveway side edge.

In FIG. 8, a further alternate embodiment 10B is shown for use on farm driveways where it is desired that the loose material be redistributed along the width of the driveway as opposed to laterally to the side of the grader. The grader 10B incorporates the same principles of the other graders in that the loose material is directed laterally across the grader into a pile 54 created by the dam blade 44 and blade 42 such that the material is permitted to flow through the passageway 50 and be redistributed on the driveway. It is seen in FIG. 8 that the blade 42 is shortened and does not extend the full width of the main frame 12. Loose material flows under the blade 44 rearwardly and under the blade 42 and out the rear end of the blade 42 such that the loose material is distributed across the driveway rather than to the side or off the driveway.

What is claimed is:

1. A vehicle drawn road scraper comprising:

a frame having a forward laterally extending frame member with substantially parallel oppositely positioned first and second side frame members interconnected at their rear ends by an angularly extending frame member which extends from the first side frame member rearwardly and laterally towards the second side frame member, said first side frame member being shorter than said second side frame member, a plurality of angularly and forwardly positioned ground engaging blades extending angularly from the second side frame member rearwardly and laterally towards the first side frame member and said angularly extending frame member, a ground engaging rear blade having forward and rearward ends on said angularly extending frame member whereby ground material loosened by said angularly and forwardly positioned blades includes first pieces which are moved into engagement with said rear blade on said angularly extending frame member with first pieces moving under said blade on said angularly extending frame member and second pieces being moved angularly along said rear blade on said angularly extending frame member and being further reduced in size such that loose ground material is redistributed onto the road surface, and a dam blade being positioned rearwardly of said plurality of angularly positioned blades and between said second side frame member and said rear blade on said angularly extending frame member, said dam blade terminating rearwardly in spaced relationship to said rear blade thereby creating a passageway therebetween for loose material boiling up between said rear blade and said dam blade being partially discharged through said passageway.

2. A vehicle drawn road scraper comprising:

a frame having a forward laterally extending frame member with substantially parallel oppositely positioned first and second side frame members interconnected at their rear ends by an angularly extending frame member which extends from the first side frame member rearwardly and laterally towards the second side frame member, said first side frame member being shorter than said second side frame member, a plurality of angularly and forwardly positioned ground engaging blades extending angularly from the second side frame member rearwardly and laterally towards the first side frame member and said angularly extending frame member, a ground engaging rear blade having forward and rearward ends on said angularly extending frame member whereby ground material loosened by said angularly and forwardly positioned blades includes first pieces which are moved into engagement with said rear blade on said angularly extending frame member with first pieces moving wider said rear blade on said angularly extending frame member and second pieces being moved angularly along said rear blade on said angularly extending frame member and being further reduced in size such that loose ground material is redistributed onto the read surface, and adjustable transport and blade depth control wheels being provided on said frame.

3. A vehicle drawn road scraper comprising:

a frame having a forward laterally extending frame member with substantially parallel oppositely positioned first and second side frame members interconnected at their rear ends by an angularly extending frame member which extends from the first side frame member rearwardly and laterally towards the second side frame member, said first side frame member being shorter than said second side frame member, a plurality of angularly and forwardly positioned ground engaging blades extending angularly from the second side frame member rearwardly and laterally towards the first side frame member and said angularly extending frame member, a ground engaging rear blade having forward and rearward ends on said angularly extending frame member whereby ground material loosened by said angularly and forwardly positioned blades includes first pieces which are moved into engagement with said rear blade on said angularly extending frame member with first pieces moving under said rear blade on said angularly extending frame member and second pieces being moved angularly along said rear blade on said angularly extending frame member and being further reduced in size such that loose ground material is redistributed onto the road surface, and said frame including a dam blade having a rear end spaced from said rear blade on said angularly extending frame member whereby loosened ground material may be accumulated between said rear blade and dam blade and may flow through said space and rearwardly and laterally along said rear blade on said angularly extending frame member.

4. The road scraper of claim 3 wherein said frame includes a pivotal wing section which includes the first side frame member.

5. The road scraper of claim 3 wherein said road scraper has a longitudinal center line and an additional angularly and forwardly positioned blade is provided extending in a direction approximately ninety degrees from said first mentioned angularly forwardly positioned ground engaging blades to direct ground material rearwardly along the longitudinal center line of said frame.

6. A vehicle drawn road scraper comprising:

a frame having a forward laterally extending frame member with substantially parallel oppositely positioned first and second side frame members interconnected at their rear ends by an angularly extending frame member which extends from the first side frame member rearwardly and laterally towards the second side frame member, said first side frame member being shorter than said second side frame member, a plurality of angularly and forwardly positioned ground engaging blades extending angularly from the second side frame member rearwardly and laterally towards the first side frame member and said angularly extending frame member, a ground engaging rear blade having forward and rearward ends on said angularly extending frame member whereby ground material loosened by said angularly and forwardly positioned blades includes first pieces which are moved into engagement with said rear blade on said angularly extending frame member with first pieces moving under said rear blade on said angularly extending frame member and second pieces being moved angularly along said rear blade on said angularly extending frame member and being further reduced in size such that loose ground material is redistributed onto the road surface, and an elongated magnet being laterally positioned on said frame spaced from the ground to pick up metal items on the road.

7. A vehicle drawn road scraper comprising:

a frame having a forward laterally extending fine member with substantially parallel oppositely positioned first and second side frame members interconnected at their rear ends by an angularly extending frame member which extends from the first side frame member rearwardly and laterally towards the second side frame member, said first side frame member being shorter than said second side frame member, a plurality of angularly and forwardly positioned ground engaging blades extending angularly from the second side frame member rearwardly and laterally towards the first side frame member and said angularly extending frame member, a ground engaging rear blade having forward and rearward ends on said angularly extending frame member whereby ground material loosened by said angularly and forwardly positioned blades includes first pieces which are moved into engagement with said rear blade on said angularly extending frame member with first pieces moving under said blade on said angularly extending frame member and second pieces being moved angularly along said rear blade on said angularly extending frame member and being further reduced in size such that loose ground material is redistributed onto the road surface, and said first side frame member including a blade extending along its substantial length.

8. The road scraper of claim 7 wherein said blade on said first side frame member is angled rearward and laterally towards the forward end of said rear blade on said angular rear frame member.

* * * * *